US006520373B1

(12) United States Patent
Neely et al.

(10) Patent No.: US 6,520,373 B1
(45) Date of Patent: Feb. 18, 2003

(54) APPARATUS AND METHOD FOR VENDING PRODUCTS IN A GLASS FRONT MERCHANDISER

(75) Inventors: D. Joseph Neely, Winchester, VA (US); Richard A. Pollock, McKinney, TX (US)

(73) Assignee: Automated Merchandising Systems, Inc., Kearneysville, WV (US)

( * ) Notice: Subject to any disclaimer, the term of this patent is extended or adjusted under 35 U.S.C. 154(b) by 0 days.

(21) Appl. No.: 09/692,514

(22) Filed: Oct. 20, 2000

(Under 37 CFR 1.47)

Related U.S. Application Data

(60) Provisional application No. 60/160,902, filed on Oct. 22, 1999.

(51) Int. Cl.[7] ..... G07F 11/00

(52) U.S. Cl. ..... 221/75; 221/311

(58) Field of Search ..... 221/75, 277, 92, 221/131, 124, 261, 311; 211/59.2, 59.3

(56) References Cited

U.S. PATENT DOCUMENTS

| | | | | |
|---|---|---|---|---|
| 3,348,732 A | | 10/1967 | Schwarz | |
| 3,828,971 A | * | 8/1974 | Offutt et al. | 221/75 |
| 4,023,704 A | | 5/1977 | Pitel et al. | |
| 5,649,641 A | | 7/1997 | Campoli | |

FOREIGN PATENT DOCUMENTS

| | | |
|---|---|---|
| BE | 422 127 | 6/1937 |
| DE | 43 21 095 | 1/1994 |

* cited by examiner

*Primary Examiner*—Kenneth W. Noland
(74) *Attorney, Agent, or Firm*—The Law Offices of Timothy J. Klima

(57) ABSTRACT

The invention is a snack style clear front merchandiser having a horizontal product column with a front opening leading into a vend space. A product mover pushes a product through the front opening and into the vend space. A retaining device, mounted to the merchandiser near the front opening and positioned in a manner such that a top of the product being vended hits the retaining device during vending, prevents the product top from moving or pitching forward during a vending process. Consequently, the vended product falls freely into the delivery hopper without bridging the vending space. A single retaining device may be used for several columns in a single tray or individual retaining devices may be used for each column. The height of the retaining device can be adjusted as required for the type of product being vended in the columns. The retaining device may be rigidly or rotationally mounted to the merchandiser. Where a U-shaped retaining device is rotationally mounted to the merchandiser, the retaining device rotates forward when a product comes in contact with the retaining device before causing the product to rotate. The retaining device then rotates back into a vertical standby position so that the free fall of products from trays above the retaining device is not obstructed. A method for vending products is also disclosed.

16 Claims, 13 Drawing Sheets

APPARATUS AND METHOD FOR VENDING PRODUCTS IN A GLASS FRONT MERCHANDISER

CROSS-REFERENCE

This application relies on U.S. Provisional Application No. 60/160,902, filed Oct. 22, 1999, (including its specification, drawings, and photographs) for priority. That application is hereby incorporated by reference into this application.

FIELD OF THE INVENTION

The present invention relates to an apparatus and method for vending tall products in a standard, snack style, glass front merchandiser.

BACKGROUND OF THE INVENTION

Glass front merchandisers are vending machines designed for the automated selling of many sizes and shapes of snack, candy, and beverage products.

As illustrated in FIGS. 1–4, commercial merchandisers generally incorporate several horizontal trays 10 that are partitioned into columns 11, each of which contains several of the same products offered for sale. Each column 11 is fitted with a motor driven helix 12 that extends from the rear of the tray to a front edge 18. The products to be vended, such as bottles 14, are retained within the helix 12.

During the vending process, the helix 12 rotates to push the product (such as the bottle 14) forward toward the front edge 18 of the product tray 10. When the product reaches the front edge 18 of the tray 10, it is pushed off of the tray 10 by the rotation of the helix 12 and drops freely into a delivery hopper (not shown) at the bottom of the vending machine. The area that the product or bottle 14 falls through is called the vend space 16.

As a rule, the width of the vend space 16 is usually the same (or substantially the same) as the width of the tray 10 holding the products to be vended. Understandably, the vend space 16 extends through most (if not all) of the height of the machine, in front of one or more trays 10 of products. The depth 20 of the vend space 16 is measured from the front edge 18 of the tray to the rear surface of the glass 22 through which customers view the product to be vended. The glass 22 prevents customers from reaching in and taking the product without paying for it.

The depth 20 of the vend space 16 in most machines is in the 6 inch to 8 inch range. In developing the conventional glass-front merchandiser, the depth 20 was established by evaluating the height of typical products that were vended traditionally by such machines. The depth 20 was then set to a value greater that the height of the tallest bottle 14 (or tallest product) vended by the machine.

With the depth 20 of the vend space 16 established in this manner, no matter how the product fell from the tray 10, the product or bottle 14 could not bridge between the tray 10 and the front glass 22, because the depth 20 of the vend space 16 exceeded the height of the product. Thus, no matter how the product tumbled from the tray 10, as long as the product or bottle 14 was pushed off the shelf by the helix 12, it was expected that vending was guaranteed and the customer would get the product selected.

In recent years, however, products have been produced in ever increasing sizes. For example, bottles 14 have become taller. 20 oz. soda bottles are 9" high. 24 oz. soda bottles are 10" high. Similarly, the typical size of snack products has also increased.

If a tall product or bottle 14 is sitting vertically on the shelf and is slowly pushed forward by the helix 12, a point will be reached where more than half of the base of the product or bottle 14 passes the front edge 18 of the tray (ee FIG. 2). At this point, the product or bottle 14 will begin to pitch forward and the top of the product or bottle 24 will hit the glass 22 in the door (see FIGS. 3 and 4). If it hits it in exactly the right fashion, it will bridge between the tray 10 and the glass 22 and not vend (see FIG. 4).

The typical vending machine is designed so that, once the helix 12 has rotated a sufficient amount to vend a bottle 14 or other product, the machine retains the customer's money even if the vend has not occurred (because the product has bridged the vend space 16). An improper vend is doubly frustrating to customers because they not only lose their money, but they can also see the bridged product that they have paid for dangling right in front of them and yet beyond their reach (see FIG. 4).

The only way to reliably vend tall bottles 14 and other oversized products in existing machines is to increase the vend space 16 depth to 10 inches or more. However, this solution is not very attractive because it requires a very costly redesign of the vending machine.

Additionally, the greater the depth 20 of the vend space, the wider the machine must be to accommodate the larger vend space 16. However, if it is made too wide, the vending machine cannot be easily installed in most consumer locations because it cannot pass through a standard-sized door frame.

Instead of increasing the size of the vending machine to accommodate larger products, the machine's size may be kept the same but the vend space may be increased by shortening the length of the shelves within the vending machine. This solution, however, reduces the amount of product that can be vended by the machine before it must be restocked, which increases the operational cost of the machine.

Accordingly, a need has developed for a glass-front merchandiser that can successfully vend larger products while retaining a sufficiently narrow profile to fit through standard-sized doorways.

SUMMARY OF THE INVENTION

It is therefore an object of the present invention to provide a vending apparatus that consistently prevents a tall bottle from bridging the vend space and failing to properly vend, especially in a merchandiser having a vend space depth that is less than the height of the bottle.

It is another object of the present invention to provide an apparatus that, while primarily designed for the vending of tall, bottled products, is equally applicable to the vending of non-bottled products such as snack items with a height that exceeds the depth of the vend space.

It is still another object of the present invention to provide a modification to a vending machine that allows the vend space to be reduced in depth so that the product selling space within the machine may be maximized.

By controlling the way the bottle (or other tall product) drops from the tray, undesirable bridging can be prevented. To do this, the bottle (or product) should be controlled so that it does not tip or pitch forward during the vending operation. Preferably, the top of the product is retained on the tray until the bottom of the product is pushed completely clear of the tray. At this point, the product drops vertically down through the vend space and does not bridge.

Controlling products so that they drop in this fashion permits the vending of oversized products without having to incur the significant expense of designing a new machine with a larger vend space.

In addition, when the vending of products is controlled in the manner taught by the present invention, a machine with a smaller overall front to back depth may be designed. This permits the construction of a machine that will pass easily through narrow spaces such as doors while including a maximum amount of self space for the largest volume of products.

The present invention accomplishes controlled vending of products by mounting a retaining device on the merchandiser in such a manner that the top of the product being vended hits the retaining device and is prevented from moving or pitching forward during the vending process.

The present invention is a snack style, clear front merchandiser having at least one product column having a front opening leading into a vend space. At least one product mover is adapted to push a product through the front opening and into the vend space. At least one retaining device is mounted to the merchandiser near the front opening and positioned in a manner such that a top of the product being vended hits the retaining device, thereby preventing the top of the product from moving or pitching forward during a vending process. Consequently, the vended product falls freely into the delivery hopper without bridging the vend space.

A single retaining device may be used for several columns in a single tray. Alternatively, individual retaining devices may be used for each column such that the height of the retaining device can be adjusted as required for the type of product being vended in each column of a single tray.

Instead of being mounted to the tray, the retaining device may be rigidly mounted to the merchandiser so that it extends across the tray. Two alternatives are possible here. First, the retaining device may be mounted to a frame within the main body of the merchandiser. Second, the retaining device may be mounted to the door so that it swings out of place when the door is opened during restocking of the machine.

In still another alternative embodiment, the retaining device may be U-shaped. Each end of the U-shaped retaining device may be rotatably mounted to the merchandiser. An axis of rotation of the rotational mounts extends horizontally in a direction perpendicular to the direction of travel of the products in the column. The retaining device is designed to rotate forward when the top of the product comes in contact with the retaining device before causing the product to rotate. Consequently, the product is rotated backward by only a small angle such that the product's free fall is more controlled. After the product has fallen into the vend space, the retaining device then returns to a vertical standby position so that the retaining device does not interfere with the free fall of products from trays above the retaining device.

In still another embodiment, the retaining device may be a U-shaped retaining device that is rotationally mounted to a tray in the merchandiser so that a single retaining device is mounted to extend across one or more columns on the tray.

Still other embodiments are described herein or will become apparent from the drawings and description that follows.

BRIEF DESCRIPTION OF THE DRAWINGS

FIGS. 1–4 are side views of a prior art vending machine, illustrating the problem described above that is associated with conventional merchandisers, wherein FIG. 1 shows a side view of a conventional merchandiser before operation;

FIG. 2 shows the conventional merchandiser when half of the base of the product has been pushed past the front edge of the tray;

FIG. 3 shows the conventional merchandiser when more than half of the base of the product has been pushed past the edge of the tray and the product pitches forward;

FIG. 4 shows the state in which the product has pitched forward and bridges the vend space but fails to vend properly;

FIGS. 6–8 show side views of the vending process of the first embodiment, wherein FIG. 6 shows the state in which the product has just come in contact with the bar and begun to rotate;

FIG. 7 shows the state in which the bottom of the product has rotated just beyond the front edge of the tray;

FIG. 8 shows the state in which the product has cleared the front edge of the tray and has begun its free fall into the delivery hopper;

FIGS. 9–13 provide several views of the vending process according to a second embodiment of the present invention, wherein FIG. 9 shows the state before the product is vended;

FIG. 10 shows the state in which the product has come into contact with and begun to rotate the bar;

FIG. 11 shows the state in which the product has cleared the tray and has begun its free fall into the delivery hopper;

FIG. 12 shows the state in which the bar has rotated back into its standby vertical position after the product has cleared the tray;

FIG. 13 shows a perspective view of the second embodiment illustrated in FIGS. 9–12;

DETAILED DESCRIPTION OF THE PREFERRED EMBODIMENTS

Figure 1:
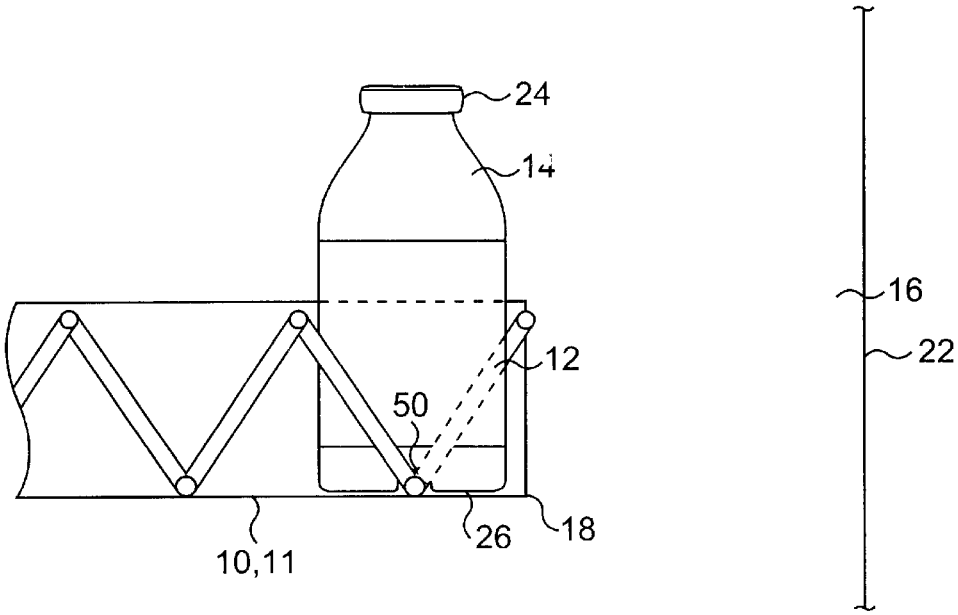
FIG. 1 (PRIOR ART)
Figure 2:
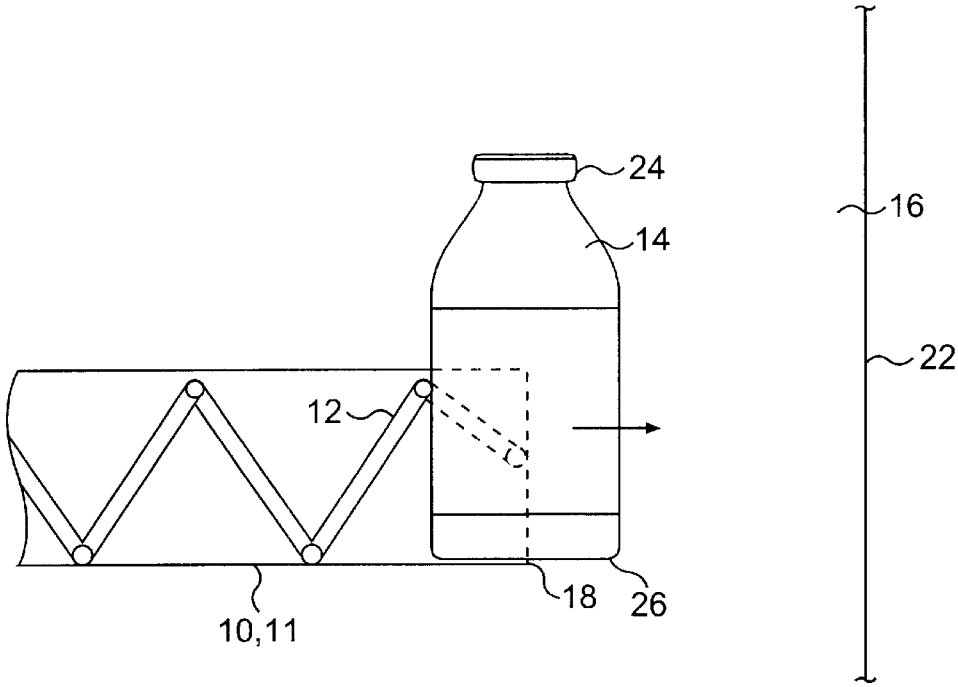
FIG. 2 (PRIOR ART)
Figure 3:
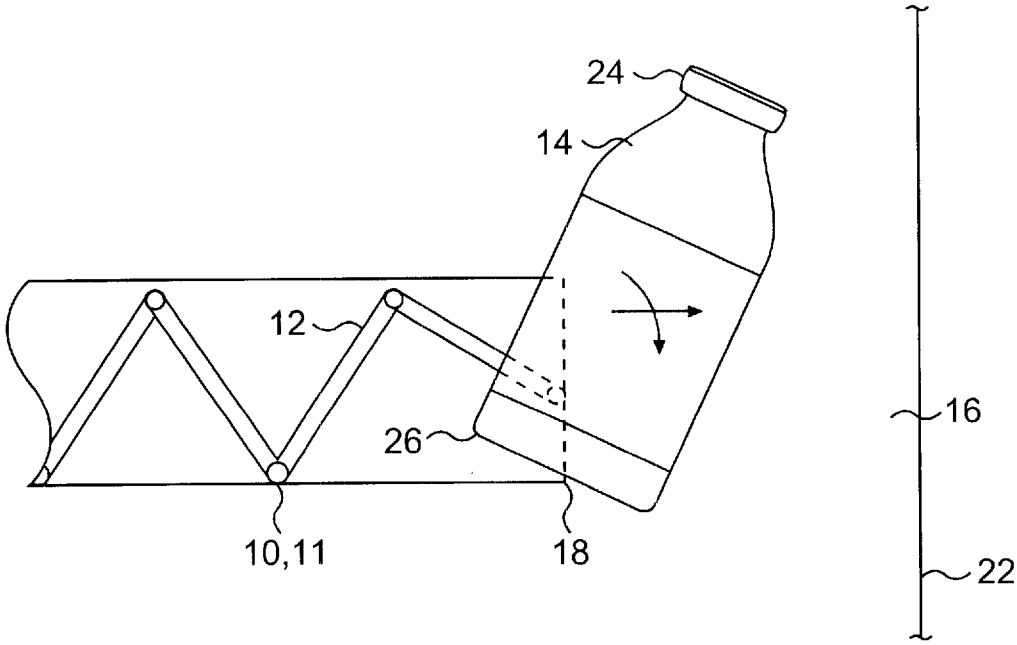
FIG. 3 (PRIOR ART)
Figure 4:
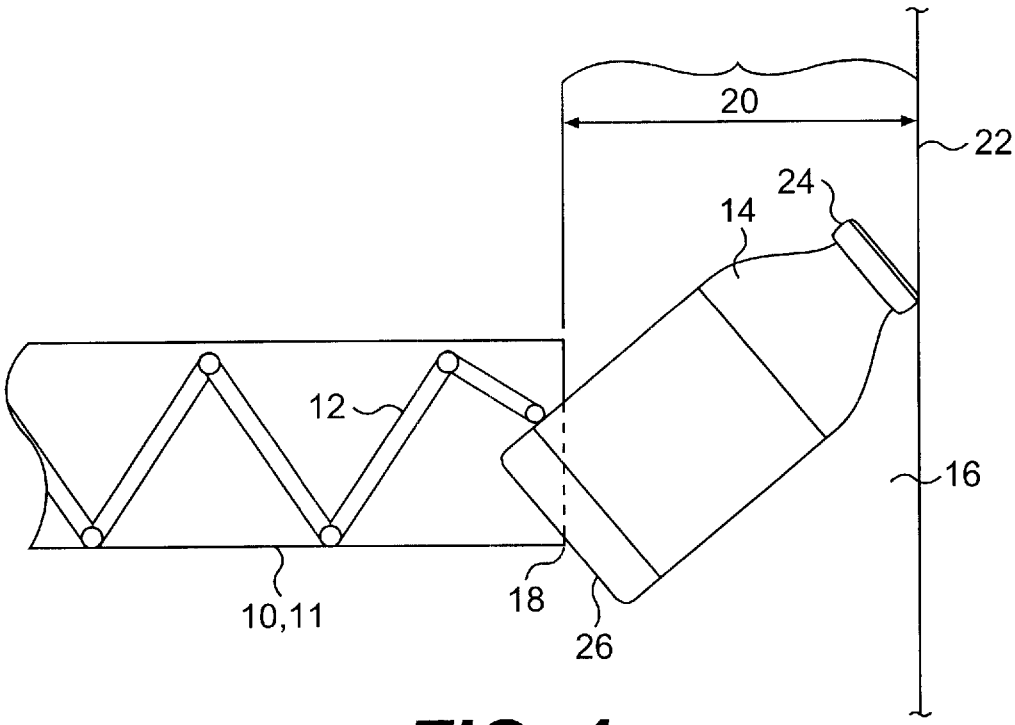
FIG. 4 (PRIOR ART)

The various figures illustrating the advantages of the present invention show a bottle 14 as the product to be vended. While the present invention was specifically created for the purpose of vending bottled products, those skilled in the art should recognize that the present invention it not limited only to the vending of such products. The present invention may be used equally for any other product that may be prone to bridging the vend space 16 between the front edge 18 of the tray 10 and the glass 22 at the front of the merchandiser.

Figure 5:
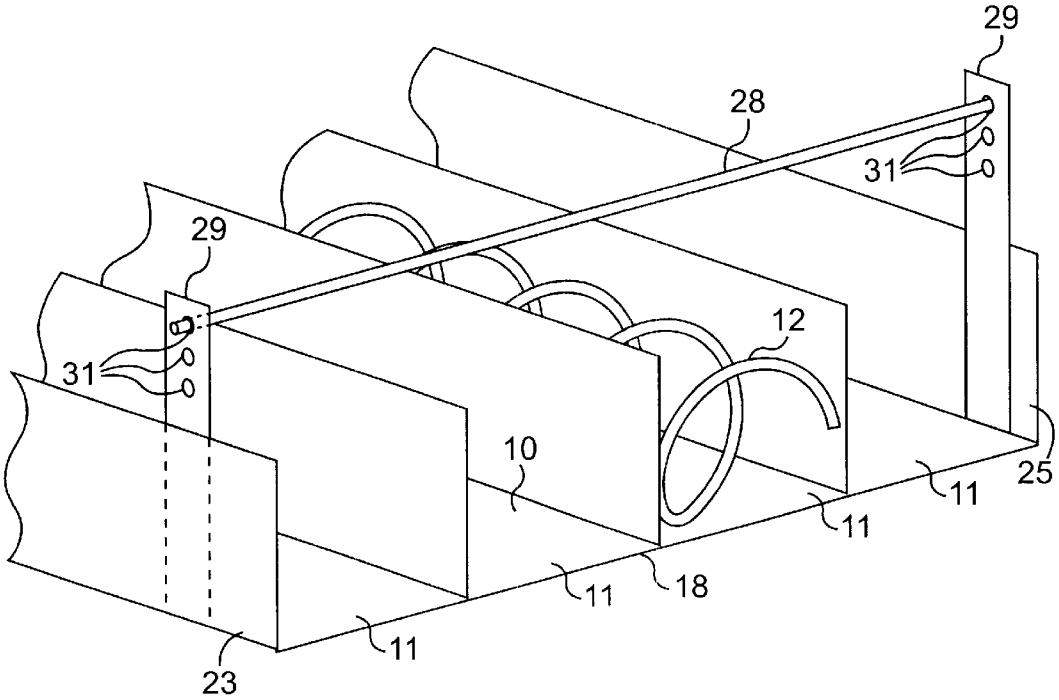
FIG. 5 shows a perspective view of the present invention according to a first embodiment.

FIG. 5 shows a perspective view of a first embodiment of the present invention. In this first embodiment, a retaining device 28, which is shown as a bar, is rigidly mounted to one tray 10 in the merchandiser via supports 29. In this embodiment, the supports 29 are affixed to end walls 23, 25 of the tray 10. The supports 29 may be affixed to the end walls 23, 25 by any suitable means including welding, fasteners, or adhesives, as would be understood by those skilled in the art. Alternatively, the supports 29 may be formed as an integral part of the end walls 23, 25.

In the embodiment illustrated in FIG. 5, the bar 28 is positioned in a manner such that, when the top of the bottle 14 being vended hits the bar 28, it is retained from moving or pitching forward during the vending process. Consequently, the bottle 14 falls freely into the delivery hopper at the bottom of the merchandiser without bridging the vend space 20.

Figure 6:
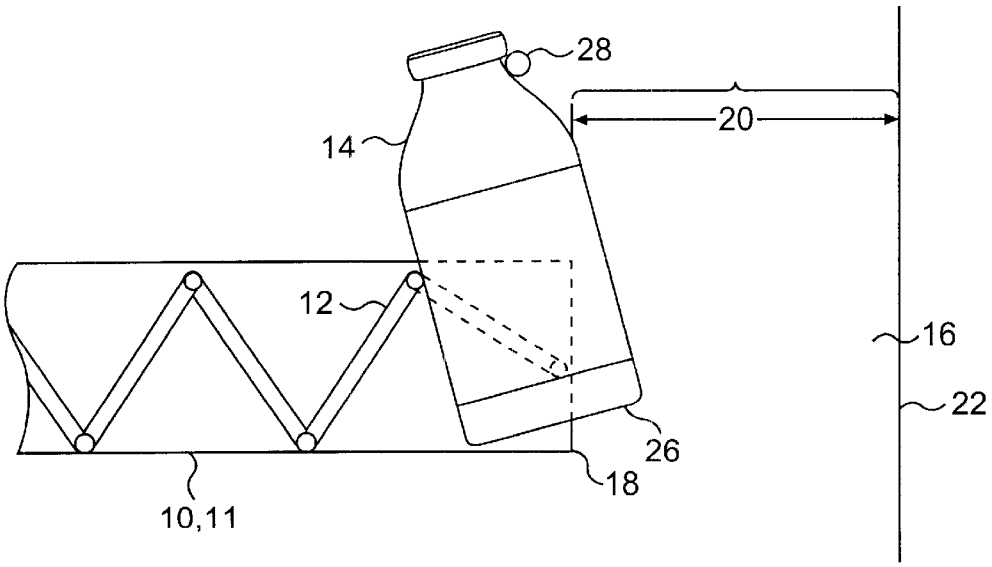
Figure 7:
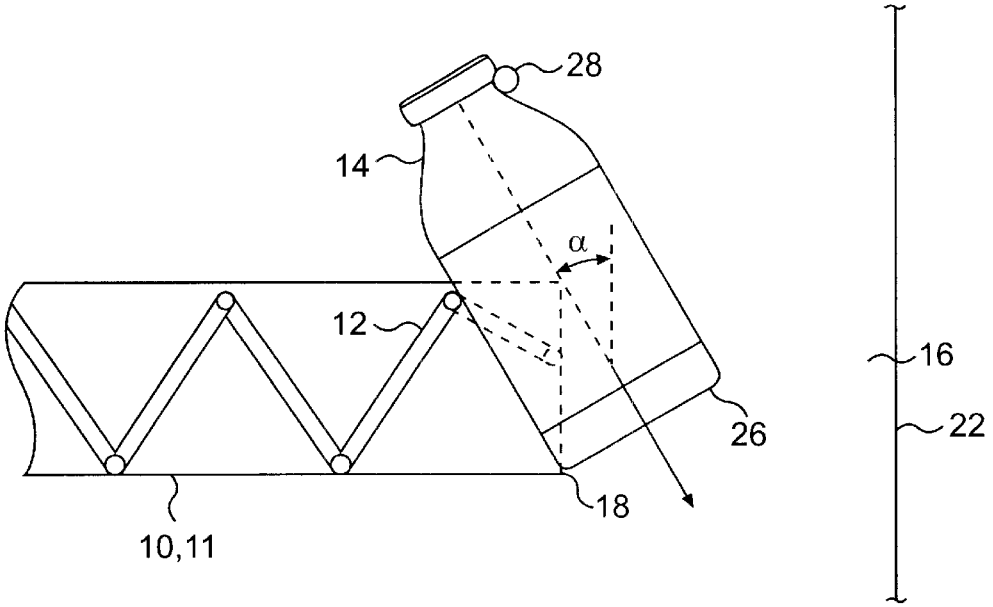
Figure 8:
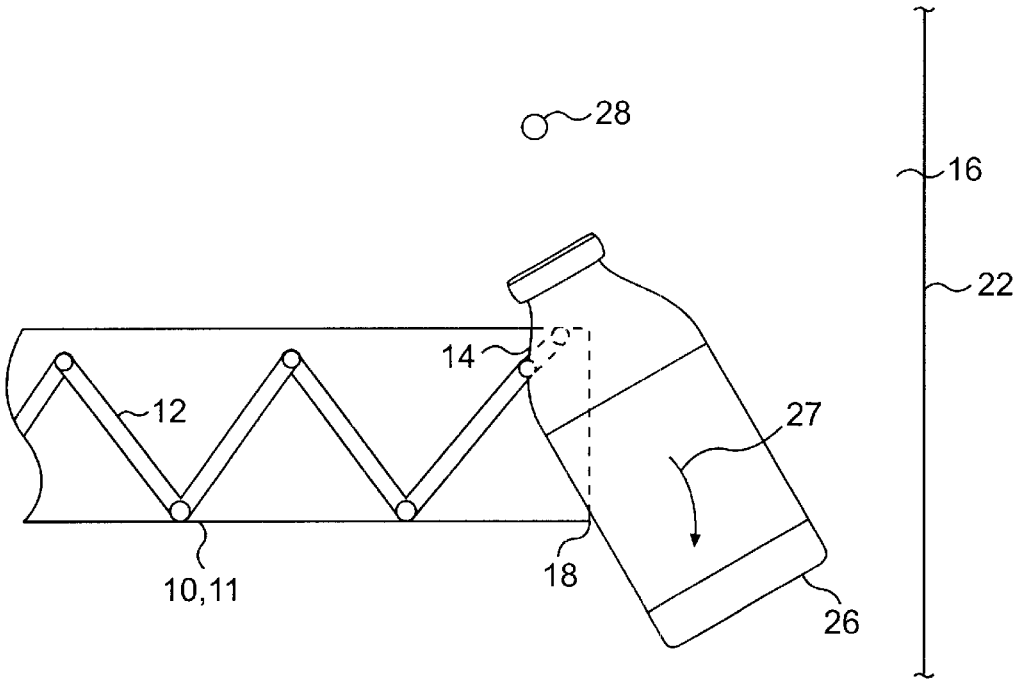

The vending process that occurs with the first embodiment of the present invention is illustrated chronologically in FIGS. 6–8. As shown in FIG. 6, once activated, the helix 12 rotates, pushing the bottle 14 toward the front edge 18 of tray 10. When the top of bottle 14 hits bar 28, it is retained from further forward movement by the bar 28. Accordingly, as the helix 12 continues to rotate, only the bottom 26 of the bottle 14 continues to move toward the vend space 16.

As illustrated in FIGS. 7 and 8, after further rotation of the helix 12, the bottom 26 of the bottle 14 eventually clears the front edge 18 of the tray 10, and the bottle 14 falls into the vend space 16 in the manner indicated by arrow 27. The bottle 14 then drops down into the delivery hopper (not shown) at the bottom of the vending machine. Because the bar 28 prevents bottle 14 from tipping forward and bridging the vend space 16, proper delivery of the bottle 14 is ensured.

In the embodiment illustrated in FIGS. 5–8, it is preferred that the bar 28 be positioned inwardly of the front edge 18 of the tray 10 such that bottle 14 falling from a higher tray 10 does not hit a bar 28 on a lower tray 10, get caught, and fail to vend properly. FIG. 5 shows the position of such a bar 28 extending across the entire tray 10 such that the bar 28 works with each of the columns 11 of tray 10 without protruding into the vend space 16.

To allow the bar 28 to be installed at a variety of heights, multiple mounting holes 31 are provided in the supports 29. Each of the mounting holes 31 in the supports 29 provides a different height. Each of the different heights can be selected to accommodate bottles 14 with different heights. While only three heights are illustrated, those skilled in the art will readily recognize that a fewer number or a greater number of the mounting holes 31 may be provided, depending upon the particular requirements of the vending machine. Alternatively, it is also contemplated that the supports 29 may be designed so that the bar 28 may be positioned in an infinite number of positions rather than several discrete positions, as shown.

As can be seen in FIG. 7 when the bar 28 is held in a fixed position very close and parallel to the front edge of the tray 10, the bottle 14 will be tipped backwards at about an angle of 15 degrees (angle $\alpha$) before it vends. At this angle, the bottle 14 will tend to slide along the front edge 18 of the tray 10 and accelerate downward and forward. While this motion assures a proper vend of the bottle 14, the forward velocity can be sufficient to allow the bottle 14 to strike the glass 22 and then rebound in an uncontrolled fashion. This may be detrimental to a successful vend, especially if the product is carbonated, because the contents of the bottle 14 may be shaken vigorously during the vending process.

To reduce the tendency of the bottle 14 to rebound from the glass 22 during vending, it is desirable to keep the bottle 14 in a more vertical orientation during the vending process. The more vertical the position of the bottle 14 when it vends, the smaller the chance for unwanted or uncontrolled motion of the bottle 14 during its travel through the vend space 16. By placing the bar 28 in a position forward of the front edge 18 of the tray 10, the tip angle prior to vending can be minimized. However, a bar 28 placed in front of the tray 10 will impede the travel of bottles 14 being dropped from trays 10 located above it.

A second embodiment of the present invention has been developed to address this situation by incorporating a pivoting bar 30 into the vending machine as shown in FIGS. 9–13. Because of the "U" shape of the bar 30, as the bottle 14 being vended pushes on it, the bar 30 pivots in holes 31 and allows the top 24 of the bottle 14 to move forward while continuing to prevent the bottle 14 from pitching forward. The bottle 14 does not begin to pivot backward until the bar 30 had pivoted forward to a nearly horizontal position. Consequently, the top 24 of the bottle 14 moves farther forward before being retained by the bar 30 (by comparison with the first embodiment of the present invention). In this second embodiment, the bottle 14 begins its free fall at a reduced backward angle $\beta$. As soon as the bottle 14 is vended, the weight of bar 30 swings it back to its standby position out of the way of any subsequent bottles 14 being vended from above.

Figure 9:
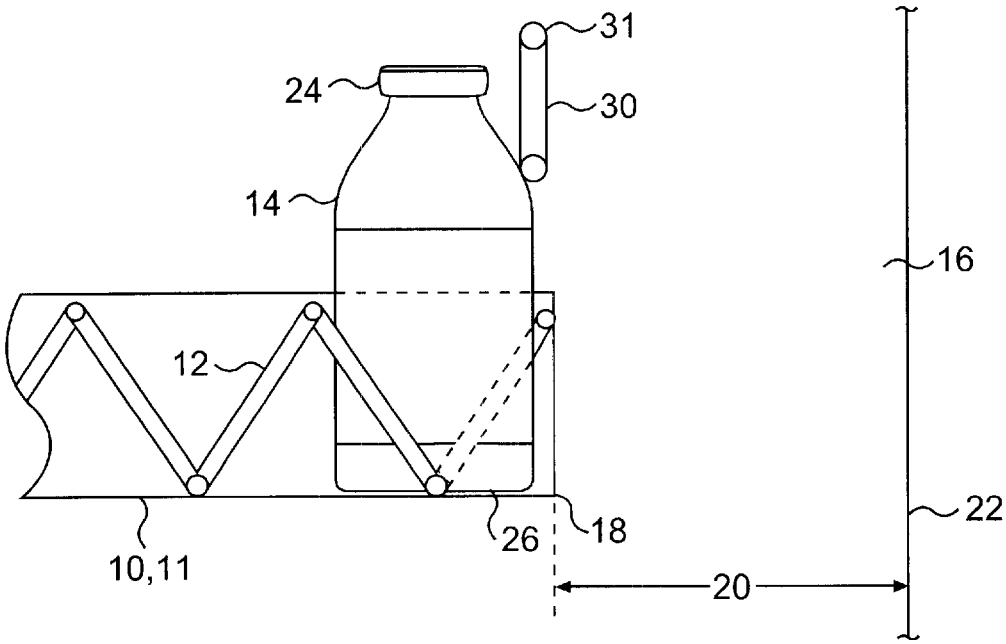
Figure 10:
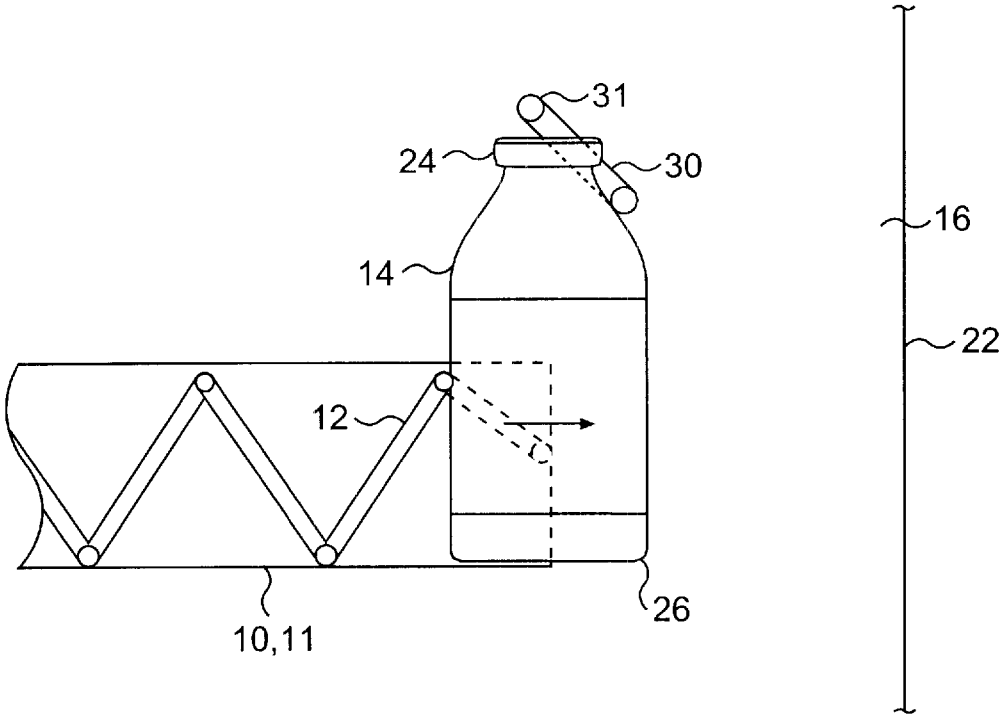
Figure 11:
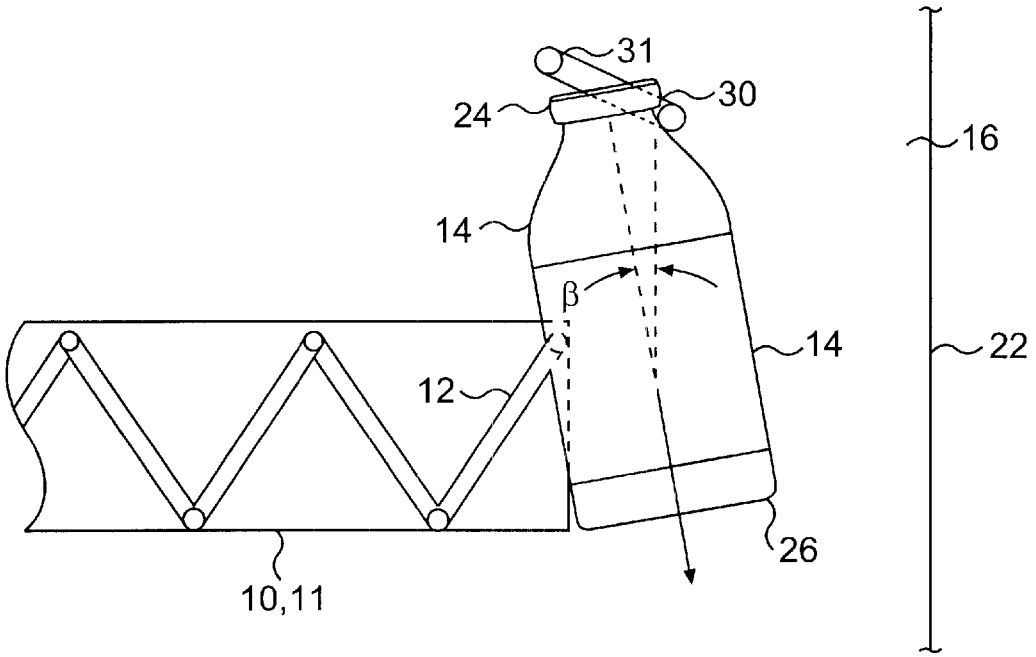
Figure 12:
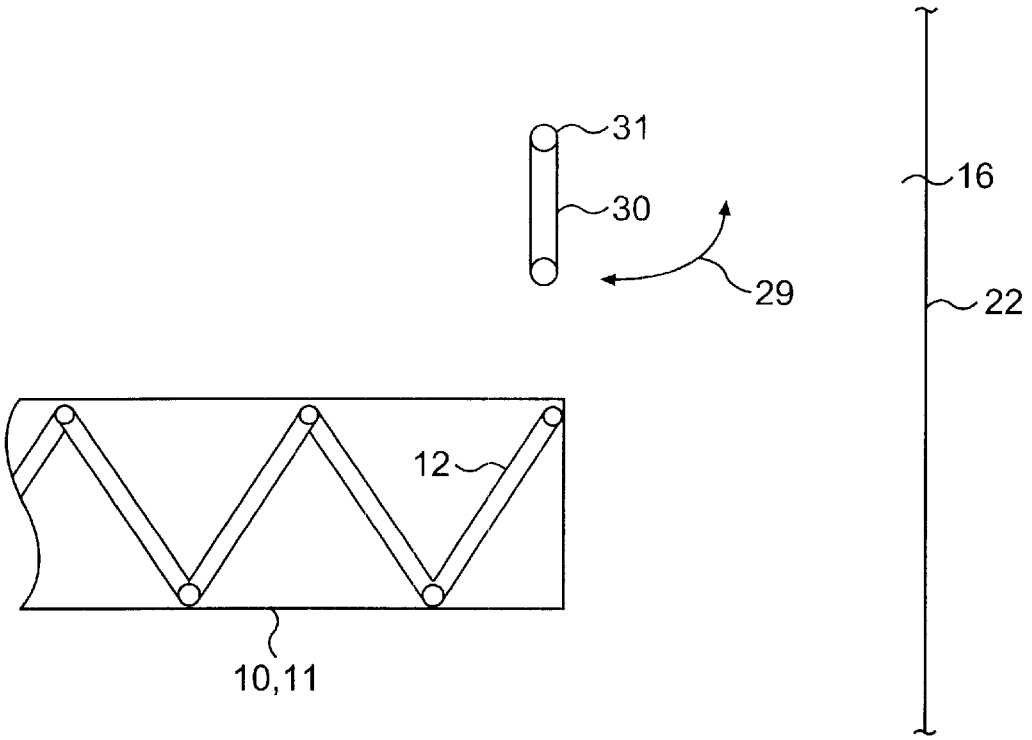
Figure 13:
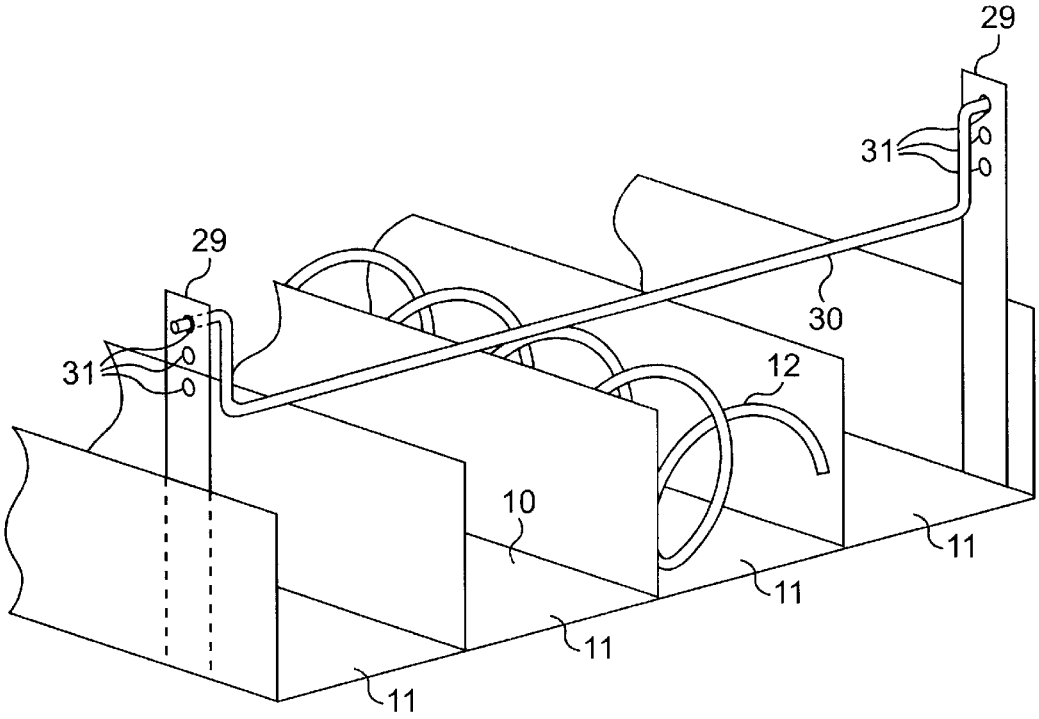

FIGS. 9–12 illustrate, in sequence, the vending process according to the second embodiment of the present invention. FIG. 9 illustrates the position of the bottle prior to vending. As the helix 12 rotates and pushes the bottle 14 forward, the bar 30 begins to rotate toward the front of the vending machine as shown in FIG. 10. Eventually, the top 24 of the bottle 14 is retained by the bar so that continued rotation of the helix 12 pushes the bottom 26 of the bottle 14 past the front edge 18 of the tray 10, as shown in FIG. 11. Once the bottle 14 falls from the tray 10, the bar rotates, under its own weight, back into a rest position, in the direction of arrow 29, as shown in FIG. 12.

FIG. 11 shows the maximum angle $\beta$ at which the bottle 14 tips in this embodiment. This angle is much smaller than angle $\alpha$ formed by the first embodiment utilizing a rigid bar 28. This embodiment is, therefore, preferred for the reasons set forth above.

Like in the first embodiment, for this second embodiment, a series of mounting holes 31 preferably are arranged in a vertical position on the supports 29 and used to adjust the height of the bar 30 to suit different heights of bottles 14. It also accommodates different configurations of the helix 12. As discussed, the bar 30 rotates or pivots in holes 31.

Figure 14:
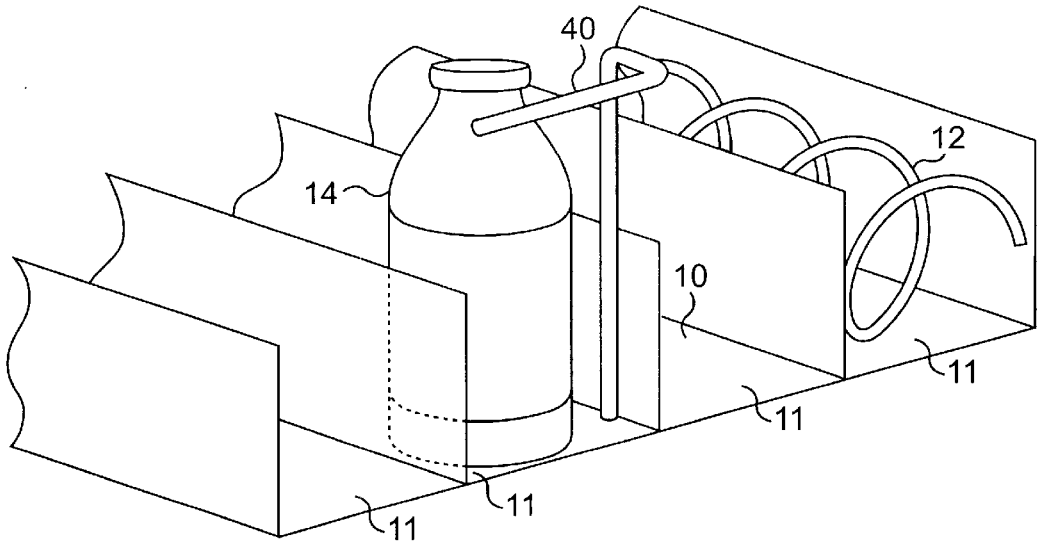
FIG. 14 shows a perspective view of a third embodiment of the present invention.

FIG. 14 illustrates a third embodiment of the present invention, which is similar to the first embodiment except that individual bars 40 replace the single bar 28 for each column 11 of the tray 10. In this embodiment, the bar 40 is rigid and does not pivot about any axis. The bar 40 may be affixed to the tray in any suitable manner such as by welding, fasteners, or adhesives. Alternatively, the bar 40 may be inserted through the bottom of the tray 10 so that it is fixed rigidly in place.

If it is desired to have the bar 40 at different heights for each individual column 11 on the same tray 10, or if it is desired to vend bottles 14 next to snack foods that do not require a bar (i.e., snack food with a small height relative to the vend distance 20), individual bars 40 can be positioned in each column 11 and installed at different heights as may be required for the optimum vending of different height bottles 14. All that is required are bars 40 of differing lengths.

Figure 15:
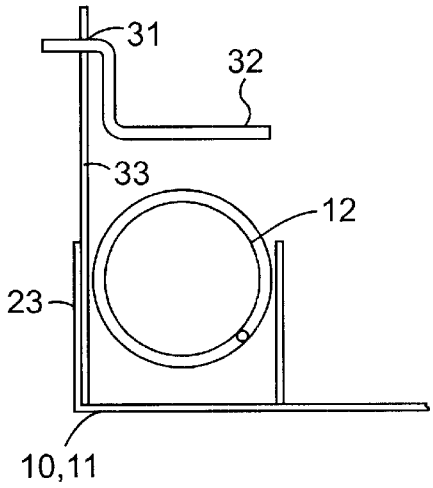
FIG. 15 shows a front view of a fourth embodiment of the present invention.

FIG. 15 shows a fourth embodiment of the present invention that is similar to the third embodiment except that a pivoting bar 32 is provided. Here, the pivoting bar 32, which is L-shaped, is used in connection with only a single column 11 like the bar 40 provided in the third embodiment. Each pivoting bar 32 is attached to single support 33 through a pivot mount hole 31. As appropriate, an additional bar 32 may be positioned in each of the remaining columns 11 of the single tray 10. As with supports 29, support 33 may be attached to the tray 10 by any suitable means including welding, fasteners, or an adhesive. Alternatively, the support 33 may be formed as an integral part of the walls of the tray 10.

Because each support preferably includes a plurality of holes 31, the bar 32 may be placed at different heights. As a result, bottles 14 having various heights may used in a single tray 10 in adjacent product columns 11. Alternatively, because the bars 32 may be positioned in individual product columns 11 in this embodiment, bottles 14 may be vended adjacent to snack foods, which may not require a bar 32 to vend properly.

As shown, the bar devices 28, 30, 32, 40 of the first through fourth embodiments are attached to tray 10. When tray 10 is pulled out to be loaded, the bars 28, 30, 32, 40 move with it. Thus, bottles 14 can be easily loaded behind the bars 28, 30, 32, 40 in the tray 10 and the bars 28, 30, 32, 40 will not interfere with loaded products when the tray 10 is pushed back into place.

While this arrangement of components is suitable, other arrangements are also possible. Specifically, the retaining device need not be attached to the tray 10. Instead, the retaining device may be attached in the cabinet of the merchandiser so that it is positioned out of the way during the tray 10 loading process but is available during the vending process to ensure a successful vend.

Figure 18:
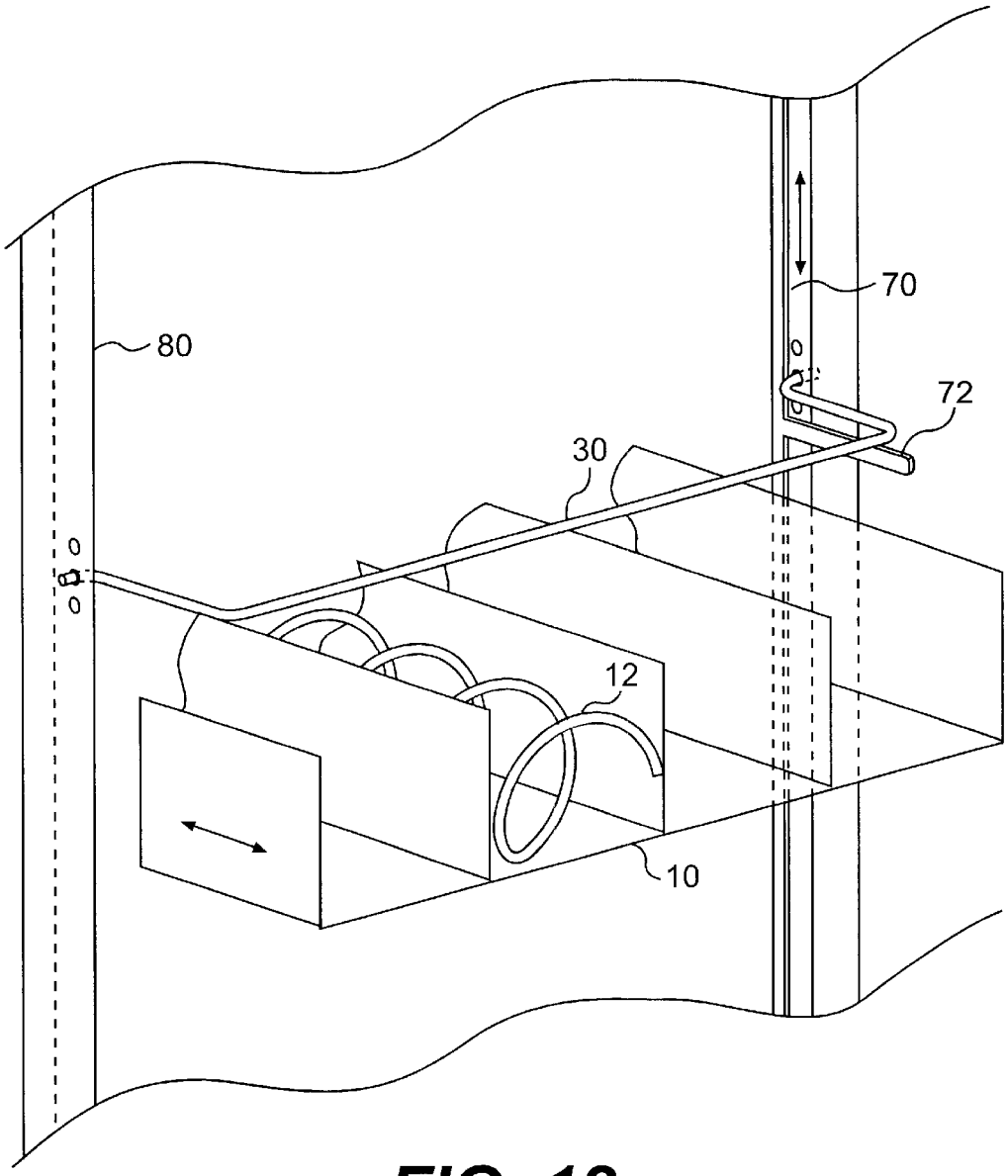
FIG. 18 shows a perspective view of a fifth embodiment of the present invention.

FIG. 18 illustrates a fifth embodiment of the present invention, which is similar to the second embodiment except that the bar 30 is mounted to the inside of the merchandiser frame rather than to the movable tray 10 itself. In this embodiment, a slidable element 70, having a protrusion 72, is provided to pivot bar 30 upward so that the bottles 14 that are on tray 10 do not hit the bar 30 when tray 10 is slid forward (direction of arrow shown on tray 10) for reloading.

As shown in FIG. 18, when the slidable element 70 is raised, the protrusion 72 lifts the bar 30, rotating the bar 30 upward and out of the way of the products on the tray 10. The slidable element 70 moves up and down (direction of the arrow shown next to the slidable element 70) to retain the bar 30 (when in the up position) for reloading and to release the bar 30 (when in the down position) for vending. Where several bars 30 are used with several vertically stacked trays 10, additional protrusions 72 can be attached to the slidable element 70 to facilitate the simultaneous raising of all of the bars 30 for all of the trays 10 in the vending machine during reloading.

Figure 19:
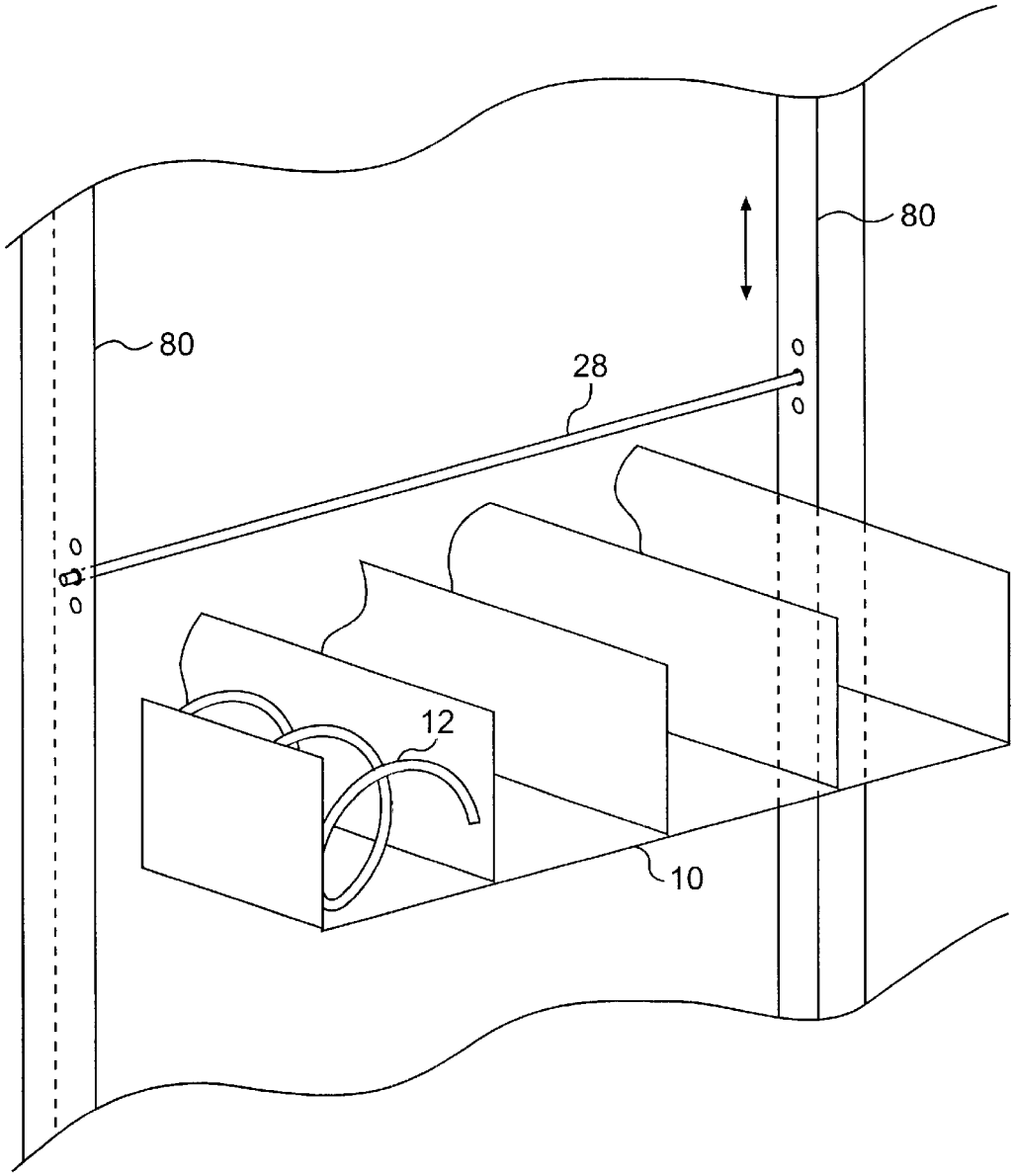
FIG. 19 shows a perspective view of a sixth embodiment of the present invention.

FIG. 19 illustrates a sixth embodiment of the present invention, which is similar to the first embodiment except that the bar 28 is attached to a sliding support 80 that can be moved up and down (direction of arrow) in a slot (as opposed to the first embodiment, in which the bar 28 is attached directly to the tray 10). When the sliding support 80 is in the up position, the bar 28 is clear of the bottles 14, and the tray 10 may be easily slid out of the vending machine and reloaded. In the down position, the bar 28 acts as the required retainer. Several bars 28 used for several trays 10 could be attached to the sliding bar 80 to facilitate raising all of the bars 28 during reloading.

Figure 20:
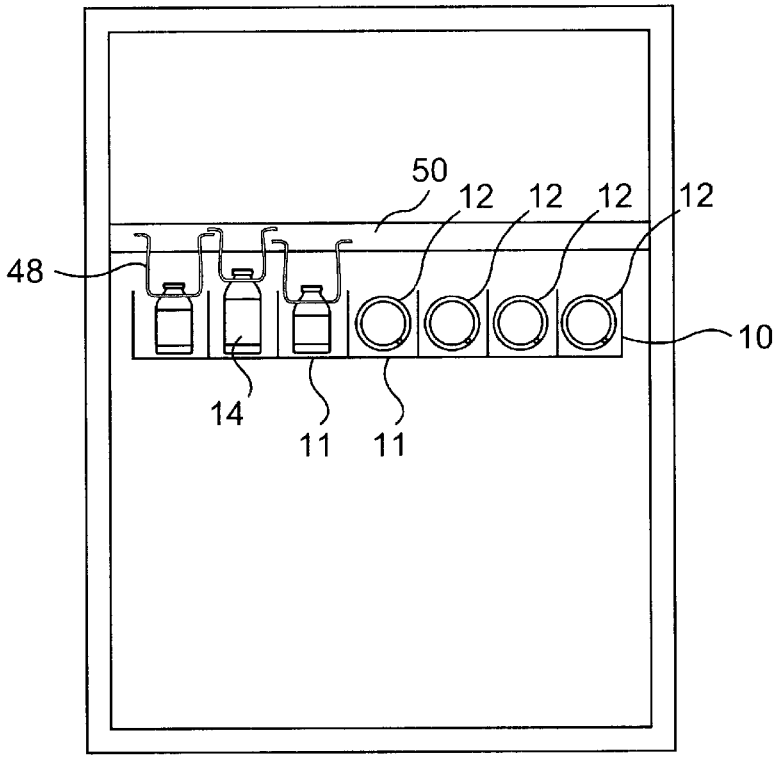
FIG. 20 provides a front view of a seventh embodiment of the present invention.
Figure 21:
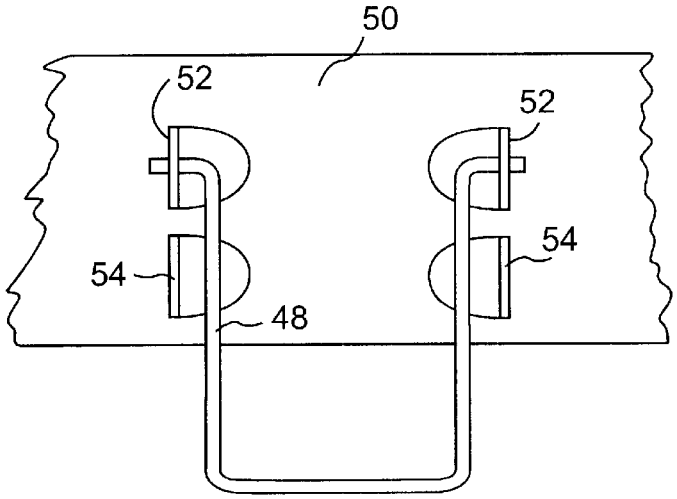
FIG. 21 provides a close-up, front view of a portion of the seventh embodiment of the present invention illustrated in FIG. 20.

FIGS. 20–23 illustrate a seventh embodiment of the present invention in detail. In this embodiment, a retaining bar 48 is pivotally attached to a pair of projecting eyelets 52, 54, which are located on a tray support bar 50 disposed above the tray 10 from which bottles 14 or other products are vended. While FIG. 21 illustrates only two pairs of eyelets 52, 54, those skilled in the art would readily recognize that any number of positions for retaining bar 48 may be provided.

Figure 22:
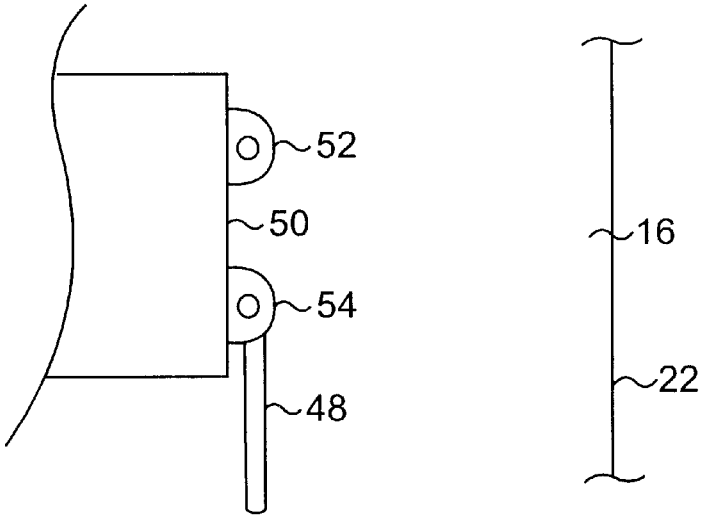
FIG. 22 is a side view illustration of a portion of the seventh embodiment of the present invention as illustrated in FIGS. 20 and 21.
Figure 23:
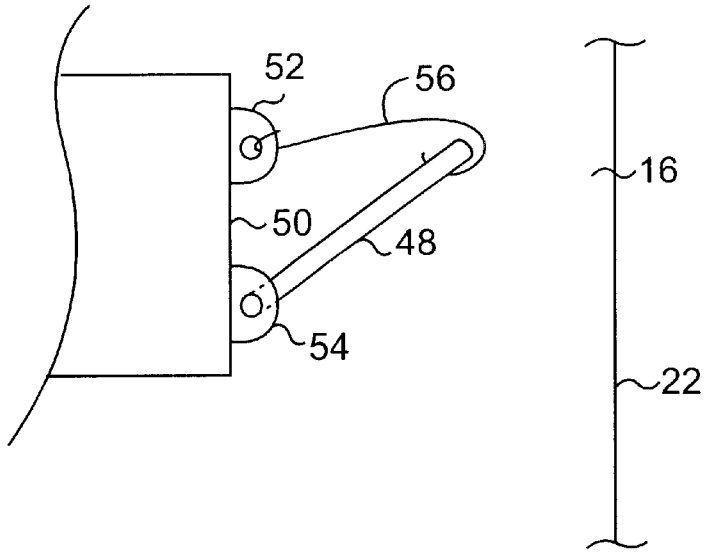
FIG. 23 is a second side view illustration of the seventh embodiment of the present invention, illustrating a retaining member that may be used to hold the retaining bar in an out-of-the-way position during loading of the vending machine.

FIGS. 22 and 23 provide side-view illustrations of the embodiment depicted in FIGS. 20–21. FIG. 22 shows the operational position of the retaining bar 48 when disposed in the lower pair of eyelets 54. As illustrated in FIG. 23, a hook 56 may or may be not permanently affixed to one of the eyelets 52. The hook 56 is designed to hold the retaining bar 48 out of the way when the tray 10 extends outwardly from the front of the vending machine for loading of new products or bottles 14.

In each of the previous embodiments, the retaining device is shown attached to the tray or to a frame element next to the tray within the vending machine. The present invention also contemplates that the retaining device or devices may be attached to the front door 59 of the merchandiser so that the retaining devices are moved away from the trays 10 when the door is opened. As such, the retaining device or devices are moved out of the way during loading of the trays 10 but are moved into an operative position to assist in vending the products when the door is closed.

Figure 24:
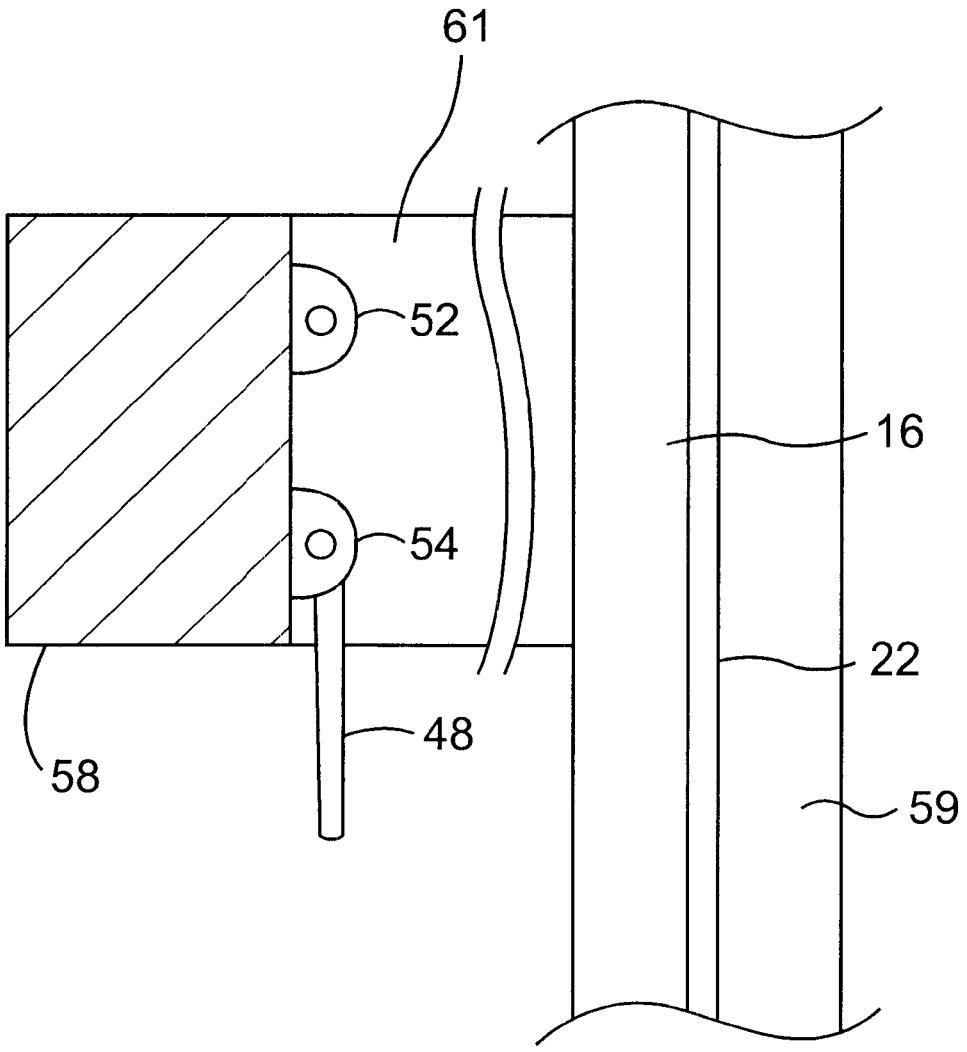
FIG. 24 illustrates an eighth embodiment of the present invention, where the retaining bars depicted in the seventh embodiment are attached to a front of the merchandiser rather than being attached to a bar extending under one of the trays.

FIG. 24 illustrates the eighth embodiment of the present invention in which the retaining device, the U-shaped bar 48, is pivotally mounted in a pair of eyelet holes 52, 54 that are mounted on a support 58. The support 58 is connected to the door 59 of the merchandiser by side brackets 61. While FIG. 24 illustrates one embodiment where the retaining device is attached to the door 59 of the merchandiser, other embodiments consistent with the present invention are also possible. For example, the bars 28, 30 of the first and second embodiments could be mounted to the brackets 61 so that they retain the product during vending but are moved out of the way when the door 59 is opened.

Figure 16:
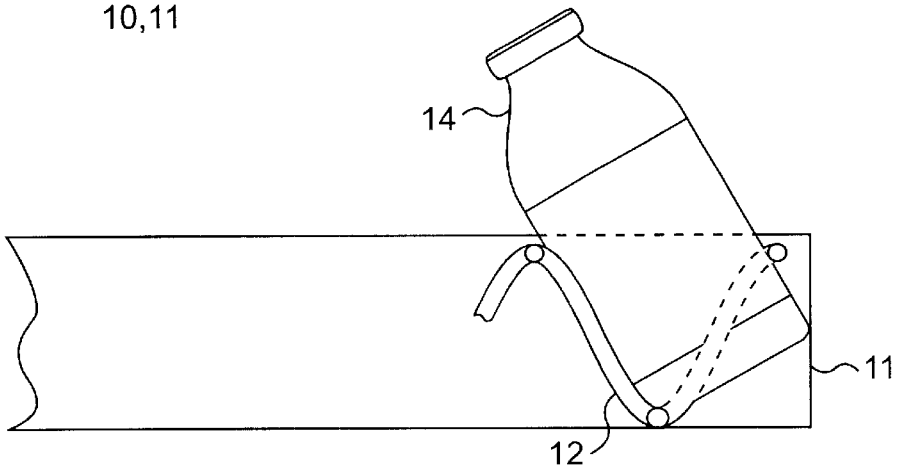
FIG. 16 shows a side view of a merchandiser where the product is retained in the rotating helix at an angle.

A further aspect of the present invention will now be described with reference to FIGS. 16 and 17.

FIG. 1 shows a bottle 14 retained in a vertical position in a column 11. This position is possible because of the flutes 50 molded into the bottom of the bottle shown. The bottom portion of the helix 12 passes through these flutes 50. A bottle 14 without these flutes 50, however, must be placed in a sloped position within the helix 12, as shown in FIG. 16. While this position will vend the product reliably, it does not present the bottle 14 in the best possible fashion for customer viewing.

Figure 17:
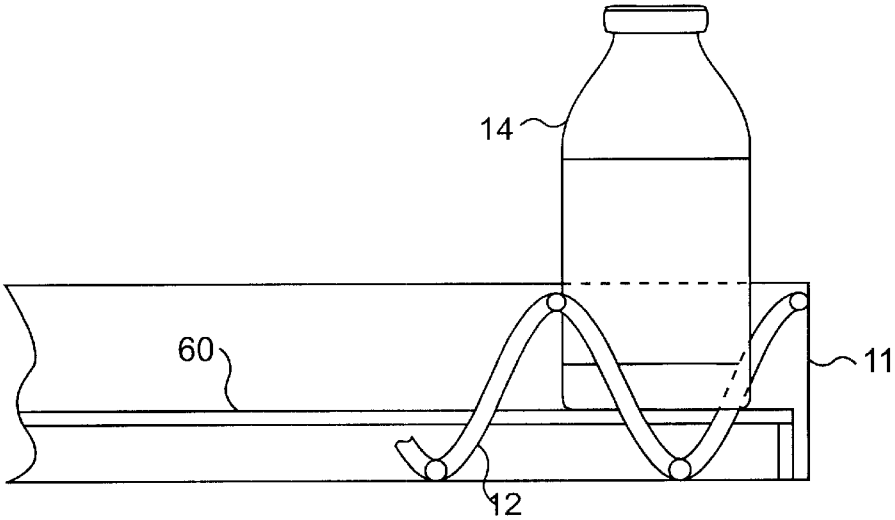
FIG. 17 shows a side view of a merchandiser having a horizontal platform that raises the product from the tray so that it is not retained in an angular fashion in the tray.

For bottles that do not include the flutes 50, a horizontal platform 60 may be placed within the helix 12, as illustrated in FIG. 17. The platform 60 provides the bottle 14 with a smooth horizontal surface to slide on so that it is held in a vertical position. The platform 60, however, exaggerates the drawbacks associated with bridging of the product during vending because it raises the bottle to an even greater height off of the tray 10. Understandably, the bottle 14 may tip forward before vending and bridge the vend space 16. The bar devices 28, 30, 32, 40, 48 of various embodiments of the present invention work equally well with this platform 60 as they do when the product is vended from the bottom of tray 10.

As discussed above, while the Figures illustrate the vending of a bottled beverage 14, the product could just as well be any other type of tall product. The concept is the same regardless of the specific product vended. The object is to push the bottom edge 26 of the product off the tray 10 while retaining the product in as vertical a position as possible prior to its falling through the vend space 16.

While a rod is preferred for the retaining device 28, 30, 32, 40, 48, the retaining device could just as easily be constructed from a piece of sheet metal or perhaps a molded configuration. As described herein, there could be many mechanical configurations that can accomplish the same action of retaining the top 24 of the bottle 14. The focus of the present invention is to place a restraint on the top of the bottle 14 so that the bottle 14 remains on the tray 10 until the bottom 26 is pushed clear of the tray 10.

The above description and drawings are illustrative only because modifications could be made without departing from the present invention, the scope of which is to be limited only by the following claims.

What is claimed is:

1. A vending machine, comprising:

a front;

a plurality of product columns, disposed side-by-side, defining a tray with first and second sides, the tray defining a front opening, the front and the front opening defining a vend space therebetween;

a plurality of product movers, one for each of the plurality of product columns, for pushing a product from the product columns into the vend space; and at least one retaining device mounted near the front opening and positioned such that a top of the product being vended is restrained by the retaining device to prevent the top of the product from pitching forward toward the front while being vended, wherein the at least one retaining device comprises a single bar extending transversely across the front openings of the plurality of product columns.

2. The vending machine of claim 1, wherein the retaining device is mounted between the first and second sides of the tray.

3. The vending machine of claim 2, further comprising:

a pair of supports mounted to the first and second sides of the tray, the supports defining a plurality of pairs of holes therein, wherein the retaining device is mounted to the supports in one pair of the plurality of pairs of holes so that the retaining device is suspended above the tray.

4. The vending machine of claim 1, further comprising:

a frame disposed laterally outside of the first and second sides of the tray, the frame defining first and second supports, wherein the retaining device is mounted between the first and second supports.

5. The vending machine of claim 4, wherein the first and second supports are slidable in a vertical direction and the retaining device is slidable therewith.

6. The vending machine of claim 1, wherein the retaining device is U-shaped.

7. The vending machine of claim 6, wherein the retaining device is pivotally mounted between the first and second sides of the tray.

8. The vending machine of claim 7, further comprising:

a pair of supports mounted to the first and second sides of the tray, the supports defining a plurality of pairs of holes therein, wherein the retaining device is mounted to the supports in one pair of the plurality of pairs of holes so that the retaining device is pivotally suspended above the tray.

9. The vending machine of claim 6, further comprising:

a frame disposed laterally outside of the first and second sides of the tray, the frame defining first and second supports, wherein the retaining device is mounted between the first and second supports.

10. The vending machine of claim 9, further comprising:

a slidable element disposed on at least one of the first and second supports, wherein the first and second supports are slidable in a vertical direction and the slidable element is slidable therewith.

11. A vending machine, comprising:

a front;

a plurality of product columns, disposed side-by-side, defining a tray with first and second sides, the tray defining a front opening, the front and the front opening defining a vend space therebetween;

a plurality of product movers, one for each of the plurality of product columns, for pushing a product from the product columns into the vend space; and at least one retaining device mounted near the front opening and positioned such that a top of the product being vended is restrained by the retaining device to prevent the top of the product from pitching forward toward the front while being vended, wherein the at least one retaining device extends transversely across at least a portion of the front opening of one of the plurality of product columns, and wherein the at least one retaining device is L-shaped and is pivotally mounted to the tray adjacent the front opening of the one of the product columns.

12. The vending machine of claim 11, further comprising:

a support mounted to the tray adjacent the front opening, the support defining a plurality of pairs of holes therein, wherein the retaining device is mounted to the support in one pair of the plurality of pairs of holes so that the retaining device is suspended above the tray.

13. A vending machine, comprising:

a front;

a plurality of product columns, disposed side-by-side, defining a tray with first and second sides, the tray defining a front opening, the front and the front opening defining a vend space therebetween;

a plurality of product movers, one for each of the plurality of product columns, for pushing a product from the product columns into the vend space;

a frame disposed laterally outside of the first and second sides of the tray, the frame defining first and second supports;

a bar extending between the supports;

at least one pair of eyelets disposed on the bar above at least one of the product columns, and at least one retaining device mounted near the front opening and positioned such that a top of the product being vended is restrained by the retaining device to prevent the top of the product from pitching forward toward the front while being vended, wherein the retaining device is U-shaped and is pivotally mounted to the at least one pair of eyelets.

14. A vending machine, comprising:

a front;

a plurality of product columns, disposed side-by-side, defining a tray with first and second sides, the tray defining a front opening, the front and the front opening defining a vend space therebetween;

a plurality of product movers, one for each of the plurality of product columns, for pushing a product from the product columns into the vend space;

a bar connected to the front;

at least one pair of eyelets disposed on the bar above at least one of the product columns; and at least one retaining device mounted near the front opening and positioned such that a top of the product being vended is restrained by the retaining device to prevent the top of the product from pitching forward toward the front while being vended;

wherein the retaining device is U-shaped, is pivotally mounted to the at least one pair of eyelets, and extends transversely across at least a portion of the front opening of one of the plurality of product columns.

15. The vending machine of any of claims 1–10 and 11–14, wherein the retaining device is located at a height, which is below a top of the product to be vended.

16. The vending machine of claim 15, wherein the height is adjustable.

* * * * *